US008074613B2

(12) United States Patent
Lee et al.

(10) Patent No.: US 8,074,613 B2
(45) Date of Patent: Dec. 13, 2011

(54) VARIABLE COMPRESSION RATIO APPARATUS

(75) Inventors: Eun Ho Lee, Hwaseong (KR); Jin Kook Kong, Suwon (KR); Young Nam Kim, Seongnam (KR)

(73) Assignee: Hyundai Motor Company, Seoul (KR)

( * ) Notice: Subject to any disclaimer, the term of this patent is extended or adjusted under 35 U.S.C. 154(b) by 408 days.

(21) Appl. No.: 12/498,271

(22) Filed: Jul. 6, 2009

(65) Prior Publication Data

US 2010/0000497 A1 Jan. 7, 2010

(30) Foreign Application Priority Data

Jul. 7, 2008 (KR) ..... 10-2008-0065654

(51) Int. Cl.
*F02B 75/04* (2006.01)

(52) U.S. Cl. ..... 123/48 B; 123/78 F

(58) Field of Classification Search ..... 123/48 B, 123/48 R, 78 R, 78 E, 78 F, 78 BA
See application file for complete search history.

(56) References Cited

U.S. PATENT DOCUMENTS 4,517,931 A * 5/1985 Nelson ..... 123/48 B
6,390,035 B2 * 5/2002 Moteki et al. ..... 123/78 BA
7,966,980 B2 * 6/2011 Lee et al. ..... 123/48 B

* cited by examiner

*Primary Examiner* — Michael Cuff
*Assistant Examiner* — Hung Q Nguyen
(74) *Attorney, Agent, or Firm* — Morgan, Lewis & Bockius LLP

(57) ABSTRACT

A variable compression ratio apparatus may include a connecting rod rotatably connected to the piston so as to receive the combustion force therefrom, a pin link mounted to the crankshaft and rotatably connected to the connecting rod so as to receive the combustion force from the connecting rod and rotate the crankshaft, a connecting link rotatably coupled to the pin link and changing a rotation trace of the pin link with respect to a rotation axis of the crankshaft, an eccentric camshaft provided with first and second shaft portions eccentric from each other and configured to rotate by a predetermined angle according to a driving condition of the engine, a sub control link rotatably connected to the eccentric camshaft about the first shaft portion and rotatably connected to the connecting link, and a main control link rotatably connected to the eccentric camshaft about the second shaft portion and rotatably connected to the connecting link.

9 Claims, 7 Drawing Sheets

VARIABLE COMPRESSION RATIO APPARATUS

CROSS-REFERENCE TO RELATED APPLICATION

The present application claims priority to Korean Patent Application Number 10-2008-0065654 filed Jul. 7, 2008, the entire contents of which application is incorporated herein for all purposes by this reference.

BACKGROUND OF THE INVENTION

1. Field of the Invention

The present invention relates to a variable compression ratio apparatus. More particularly, the present invention relates to a variable compression ratio apparatus that changes compression ratio of an air-fuel mixture in a combustion chamber according to a driving condition of an engine.

2. Description of Related Art

Generally, thermal efficiency of combustion engines increases as a compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be advanced a lot and accordingly engine output may deteriorate.

A variable compression ratio (VCR) apparatus changes the compression ratio of an air-fuel mixture according to a driving state of an engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

A conventional variable compression ratio apparatus includes a connecting rod connected to a piston and receiving combustion force of the air-fuel mixture, a pin link receiving the combustion force of the air-fuel mixture from the connecting rod and rotating a crankshaft, and control means changing a rotation trace of the pin link according to the driving condition of the engine. According to the conventional variable compression ratio apparatus, the compression ratio of the air-fuel mixture changes as the rotation trace of the pin link changes.

According to a conventional variable compression ratio apparatus, the control means are disposed vertically under the crankshaft or are disposed horizontally next to the crankshaft. Therefore, volume of the crank case may increase.

In addition, the compression ratio of the air-fuel mixture changes but stroke and exhaust amount does not change according to the conventional variable compression ratio apparatus.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus having advantages of being installed in a crank case without increase in size of the crank case.

In an aspect of the present invention, a variable compression ratio apparatus that is mounted at an engine receiving a combustion force of an air-fuel mixture from a piston and rotating a crankshaft, and that changes compression ratio of the air-fuel mixture, may include a connecting rod rotatably connected to the piston so as to receive the combustion force therefrom, a pin link mounted to the crankshaft and rotatably connected to the connecting rod so as to receive the combustion force from the connecting rod and rotate the crankshaft, a connecting link rotatably coupled to the pin link and changing a rotation trace of the pin link with respect to a rotation axis of the crankshaft, an eccentric camshaft provided with first and second shaft portions eccentric from each other and configured to rotate by a predetermined angle according to a driving condition of the engine, a sub control link rotatably connected to the eccentric camshaft about the first shaft portion and rotatably connected to the connecting link, and a main control link rotatably connected to the eccentric camshaft about the second shaft portion and rotatably connected to the connecting link.

An angle between the sub control link and the main control link with respect to a rotation axis of the eccentric cam shaft may be configured to change in a case that the eccentric camshaft rotates by the predetermined angle, wherein the connecting link changes the rotation trace of the pin link around the rotation axis of the crankshaft in accordance with the change of the angle between the sub control link and the main control link with respect to the rotation axis of the eccentric cam shaft.

In another aspect of the present invention, a variable compression ratio apparatus that is mounted at an engine receiving a combustion force of an air-fuel mixture from a piston and rotating a crankshaft, and that changes compression ratio of the air-fuel mixture, may include a connecting rod having one end portion rotatably connected to the piston and the other end portion, a pin link having a first connecting point rotatably connected to the other end portion of the connecting rod, a second connecting point rotatably connected to the crankshaft, and a third connecting point, a connecting link having a fourth connecting point rotatably connected to the third connecting point of the pin link, and fifth and sixth connecting points, a sub control link having one end portion rotatably connected to the sixth connecting point of the connecting link and the other end portion, a main control link having one end portion rotatably connected to the fifth connecting point of the connecting link and the other end portion, and an eccentric camshaft rotatably connected respectively to the other end portions of the main control link and the sub control link, wherein rotation axes of the other end portions of the main control link and the sub control link are configured to be offset so as to change an angle between the main control link and the sub control link with respect to a rotation axis of the eccentric camshaft.

The eccentric camshaft may include a first shaft portion at which the other end portion of the sub control link is rotatably mounted, and a second shaft portion eccentrically disposed from the first shaft portion, the other end portion of the main control link being rotatably mounted at the second shaft portion.

The eccentric camshaft may be configured to rotate by a predetermined angle according to a driving condition of the engine so as to change the angle between the main control link and the sub control link with respect to the rotation axis of the eccentric camshaft, wherein the connecting link is configured to change a rotation trace of the pin link around a rotation axis of the crankshaft in accordance with the change of the angle between the sub control link and the main control link with respect to the rotation axis of the eccentric camshaft.

The first, second, and third connecting points may form a first predetermined triangular shape.

The fourth, fifth, and sixth connecting points may form a second predetermined triangular shape.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
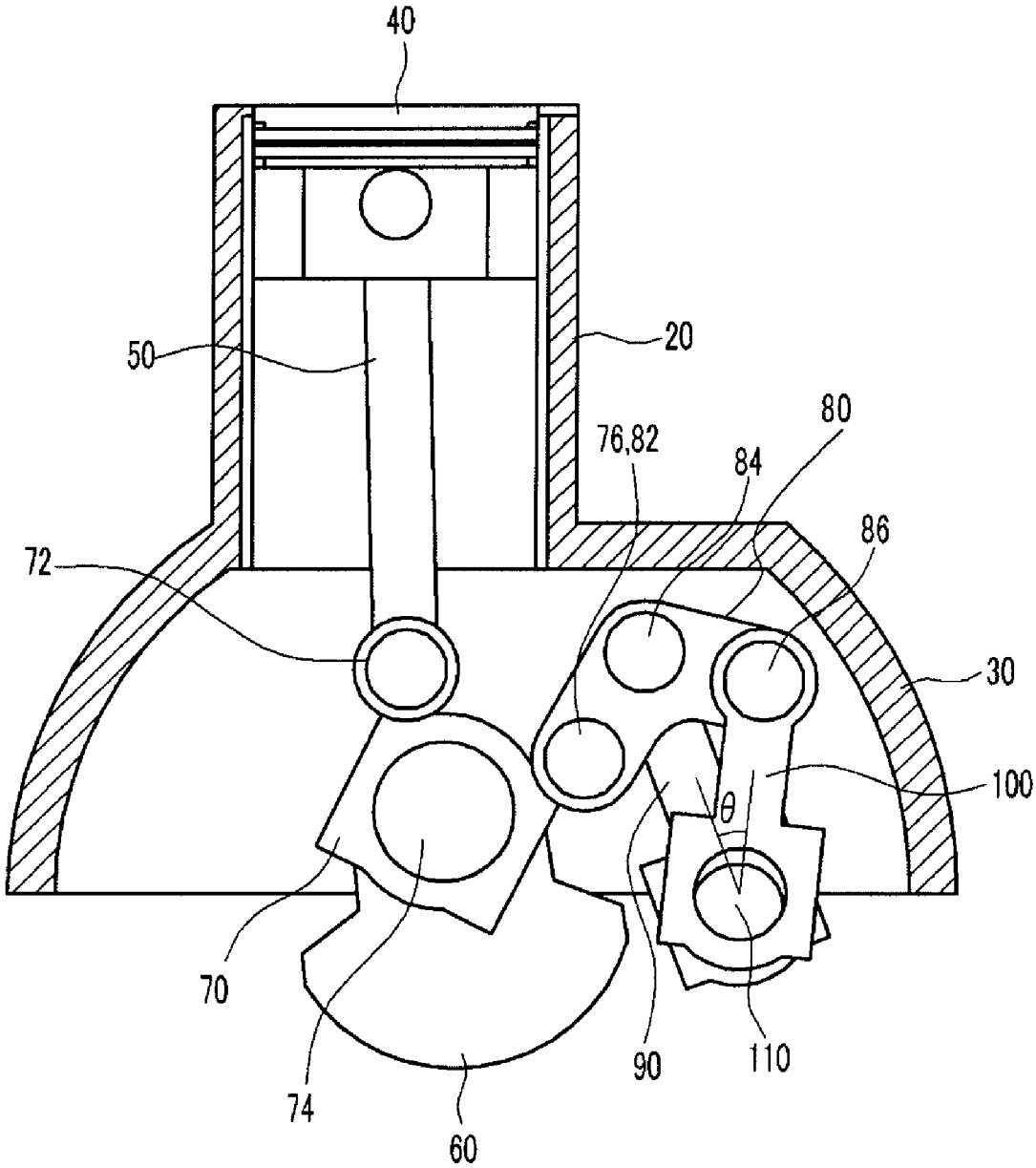
FIG. 1 is a schematic diagram of an exemplary variable compression ratio apparatus according to the present invention.

FIG. 1 is a schematic diagram of a variable compression ratio apparatus according to various embodiments of the present invention.

As shown in FIG. 1, a variable compression ratio apparatus according to various embodiments of the present invention is mounted at an engine receiving a combustion force of an air-fuel mixture from a piston 40 and rotating a crankshaft 60, and changes compression ratio of the air-fuel mixture.

The piston 40 moves upwardly or downwardly in a cylinder 20, and a combustion chamber is formed between the piston 40 and the cylinder 20.

The crankshaft 60 receives the combustion force from the piston 40, converts the combustion force into torque, and transmits the torque to a transmission. The crankshaft 60 is mounted in a crank case 30 formed under the cylinder 20.

The variable compression ratio apparatus includes a connecting rod 50, a pin link 70, a connecting link 80, a sub control link 100, a main control link 90, and an eccentric camshaft 110. Since the variable compression ratio apparatus is substantially vertically disposed next to the crankshaft 60 in the crank case 30, size of the crank case 30 may not be increased.

The connecting rod 50 receives the combustion force from the piston 40, transmits the combustion force to the pin link 70, and has both ends. One end of the connecting rod 50 is rotatably connected to the piston 40, and the other end of the connecting rod 50 is rotatably connected to the pin link 70.

The pin link 70 receives the combustion force from the connecting rod 50, rotates the crankshaft 60, and has first, second, and third connecting points 72, 74, and 76.

The first connecting point 72 is rotatably connected to the other end of the connecting rod 50, the second connecting point 74 is eccentrically and rotatably connected to the crankshaft 60, and the third connecting point 76 is rotatably connected to the connecting link 80. The first, second, and third connecting points 72, 74, and 76 are disposed in a first predetermined triangular shape, and the first predetermined triangular shape can be easily determined by a person of an ordinary skill in the art according to a target engine performance.

The connecting link 80 connects the sub control link 100 and the main control link 90 to the pin link 70 so as to change a rotation trace of the pin link 70 by control of the control links 90 and 100. The connecting link 80 includes fourth, fifth, and sixth connecting points 82, 84, and 86. The fourth connecting point is rotatably connected to the third connecting point of the pin link 70, the fifth connecting point 84 is rotatably connected to the main control link 90, and the sixth connecting point 86 is rotatably connected to the sub control link 100.

The fourth, fifth, and sixth connecting points 82, 84, and 86 are disposed in a second predetermined triangular shape, and the second predetermined triangular shape can be easily determined by a person of an ordinary skill in the art according to the target engine performance.

The sub control link 100 connects the eccentric camshaft 110 to the connecting link 80, and has both ends. One end of the sub control link 100 is rotatably connected to the sixth connecting point 86 of the connecting link 80, and the other end of the sub control link 100 is rotatably connected to the eccentric camshaft 110 about a first rotation axis Y1 (refer to FIG. 2).

The main control link 90 connects the eccentric camshaft 110 to the connecting link 80, and has both ends. One end of the main control link 90 is rotatably connected to the fifth connecting point 84 of the connecting link 80, and the other end of the main control link 90 is rotatably connected to the eccentric camshaft 110 about a second rotation axis Y2 (refer to FIG. 2).

Figure 2:
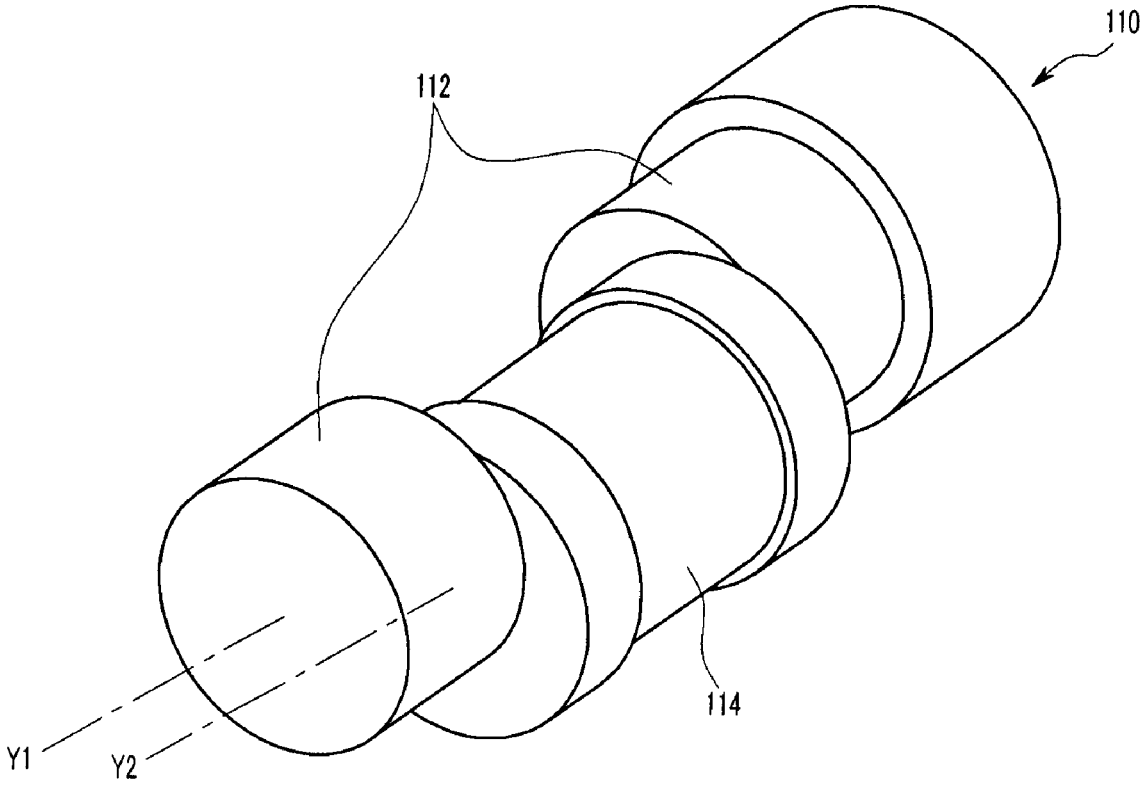
FIG. 2 is a perspective view of an exemplary an eccentric camshaft according to the present invention.

FIG. 2 is a perspective view of an eccentric camshaft according to various embodiments of the present invention.

As shown in FIG. 2, the eccentric camshaft 110 includes first and second shaft portions 112 and 114.

The other end of the sub control link 100 is mounted at the first shaft portion 112, and the sub control link 100 rotates about the first rotation axis Y1.

The second shaft portion 114 is eccentrically disposed from the first shaft portion 112. The other end of the main control link 90 is mounted at the second shaft portion 112, and the main control link 90 rotates about the second rotation axis Y2 eccentric from the first rotation axis Y1.

In addition, the eccentric camshaft 110 can rotate about the first rotation axis Y1 by a predetermined angle according to a driving condition of the engine. In this case, since the second rotation axis Y2 also rotates about the first rotation axis Y1, an angle θ between the main control link 90 and the sub control link 100 changes. Therefore, the connecting link 80 changes the rotation trace of the pin link 70 corresponding to the angle θ between the main control link 90 and the sub control link 100, and thereby, the compression ratio of the air-fuel mixture is changed.

In addition, the compression ratio of the air-fuel mixture changes according to a rotating angle of the eccentric camshaft 110, and the rotating angle of the eccentric camshaft 110 can be easily determined by a person of an ordinary skill in the art according to the target engine performance.

Figure 3:
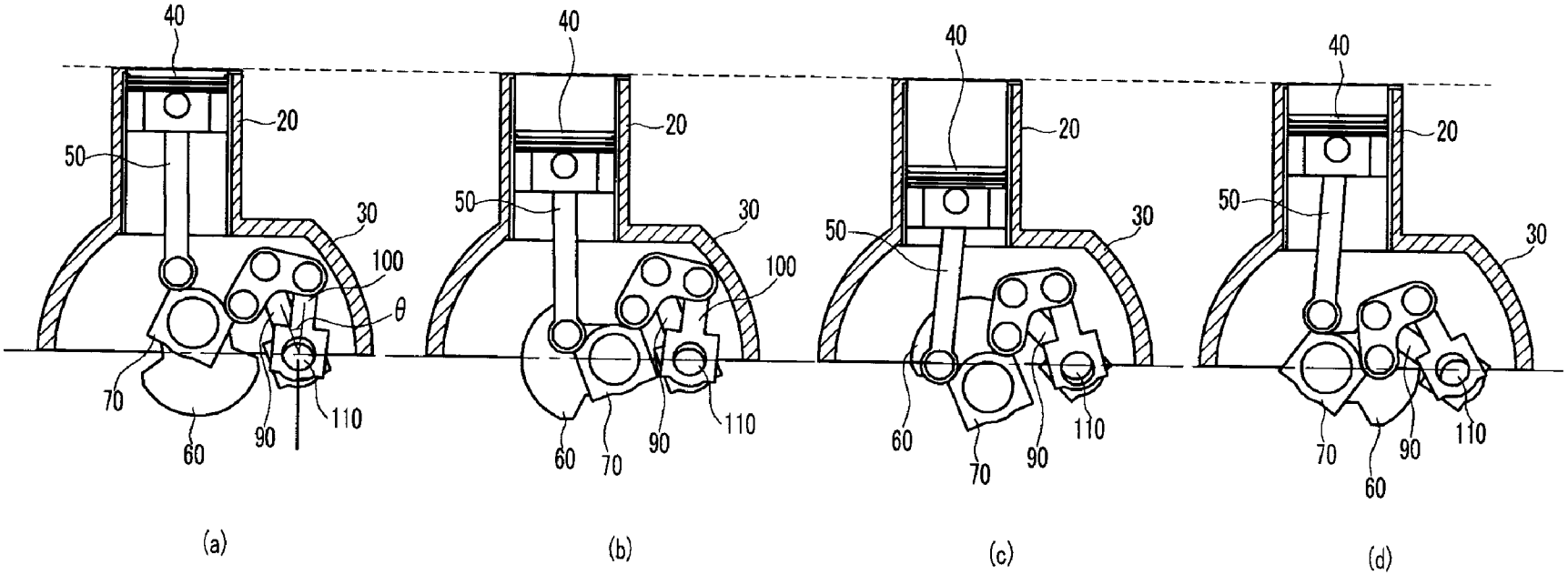
FIG. 3 is an operational diagram of an exemplary variable compression ratio apparatus according to the present invention which is operated in a state of a high compression ratio.
Figure 4:
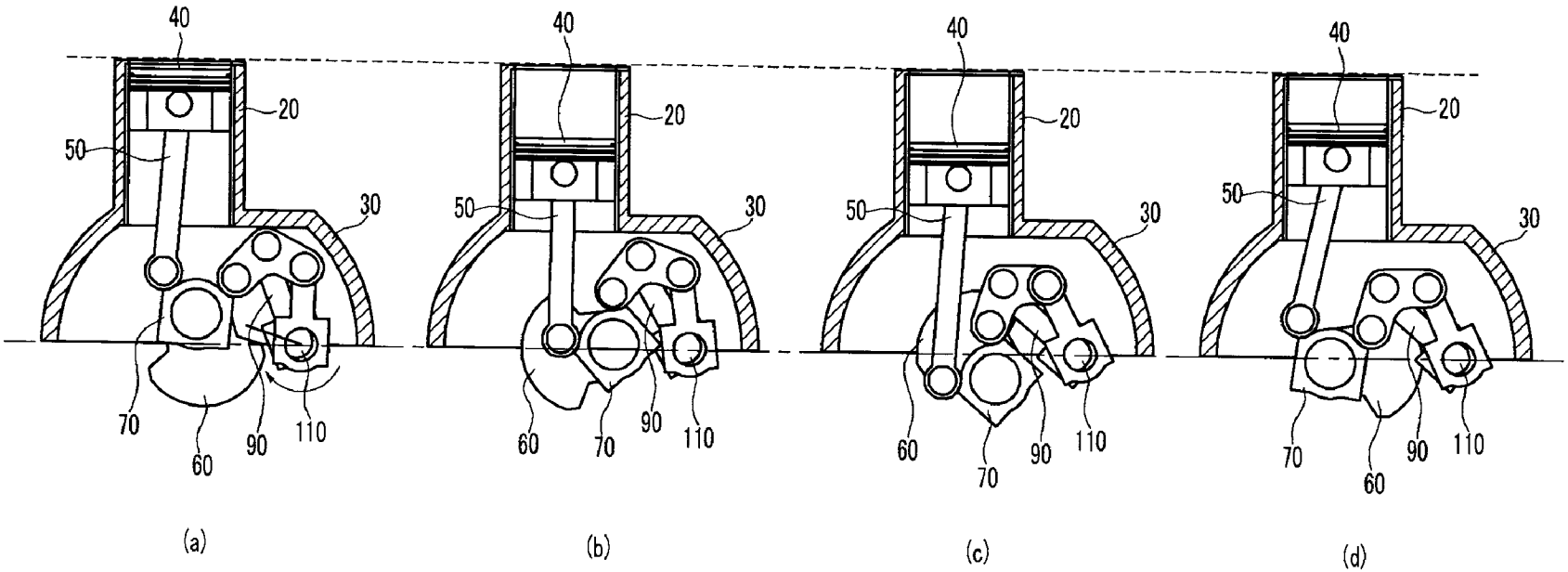
FIG. 4 is an operational diagram of an exemplary variable compression ratio apparatus according to the present invention which is operated in a state of a low compression ratio.

FIG. 3 is an operational diagram of a variable compression ratio apparatus according to various embodiments of the present invention which is operated in a state of a high compression ratio; and FIG. 4 is an operational diagram of a variable compression ratio apparatus according to various embodiments of the present invention which is operated in a state of a low compression ratio.

As shown in FIG. 3 and FIG. 4, as the eccentric camshaft 110 rotates, the angle θ between the main control link 90 and the sub control link 100 changes, and accordingly the compression ratio of the air-fuel mixture and stroke change.

Figure 5:
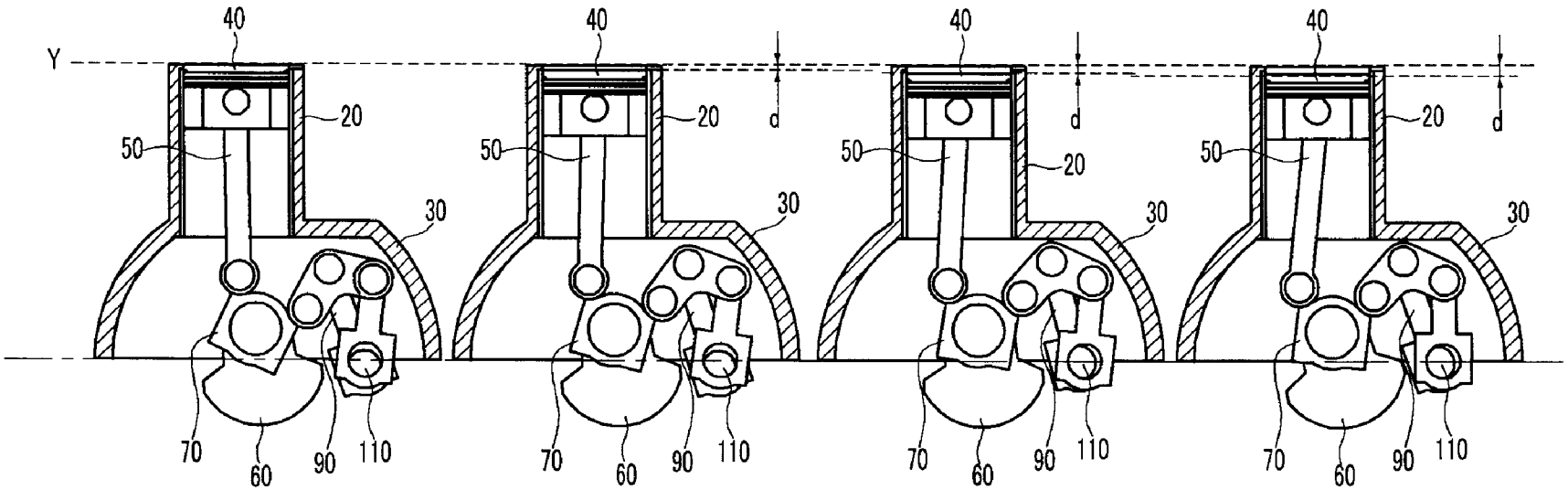
FIG. 5 shows a positional change in a top dead center of an exemplary piston corresponding to rotation of an eccentric camshaft in a variable compression ratio apparatus according to the present invention.
Figure 6:
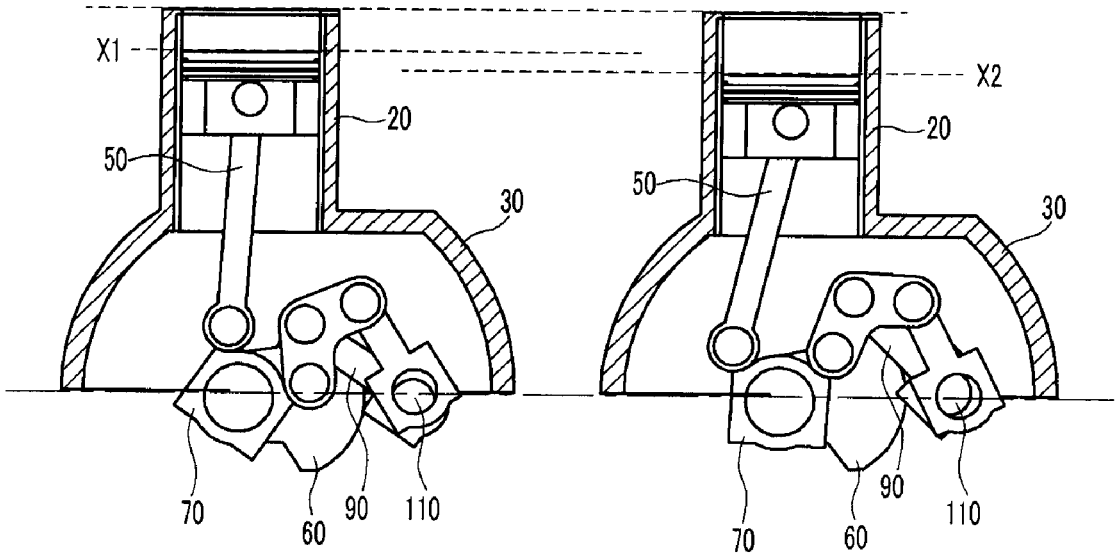
FIG. 6 shows a positional change in a bottom dead center of an exemplary piston corresponding to rotation of an eccentric camshaft in a variable compression ratio apparatus according to the present invention.

Referring to FIG. 5 and FIG. 6, changes in the compression ratio of the air-fuel mixture and the stroke will be described in further detail.

FIG. 5 shows a positional change in a top dead center of a piston corresponding to rotation of an eccentric camshaft in a variable compression ratio apparatus according to various embodiments of the present invention; and FIG. 6 shows a positional change in a bottom dead center of a piston corresponding to rotation of an eccentric camshaft in a variable compression ratio apparatus according to various embodiments of the present invention.

"Y" in FIG. 5 represents a top dead center of the piston 40 in a maximum compression ratio of the air-fuel mixture, and is used as a reference position.

As shown in FIG. 5, as the eccentric camshaft 110 rotates, the top dead center of the piston 40 goes down from the reference position Y. That is, if a distance between the reference position and a current top dead center is represented as "d", "d" becomes increase and accordingly the compression ratio of the air-fuel mixture is lowered as the eccentric camshaft 110 rotates.

"X1" in FIG. 6 represents a bottom dead center of the piston 40 in the maximum compression ratio, and "X2" in FIG. 6 represents the bottom dead center of the piston 40 in a minimum compression ratio.

As mentioned above, the top dead center of the piston 40 in the minimum compression ratio is lower than that in the maximum compression ratio by "d", and the bottom dead center X2 of the piston 40 in the minimum compression ratio is lower than that X1 in the maximum compression ratio. In this case, since difference in height between "X1" and "X2" is larger than "d", stroke in the minimum compression ratio is longer than that in the maximum compression ratio. Since the stroke is related to exhaust amount, the exhaust amount in the minimum compression ratio is larger than that in the maximum compression ratio.

Figure 7:
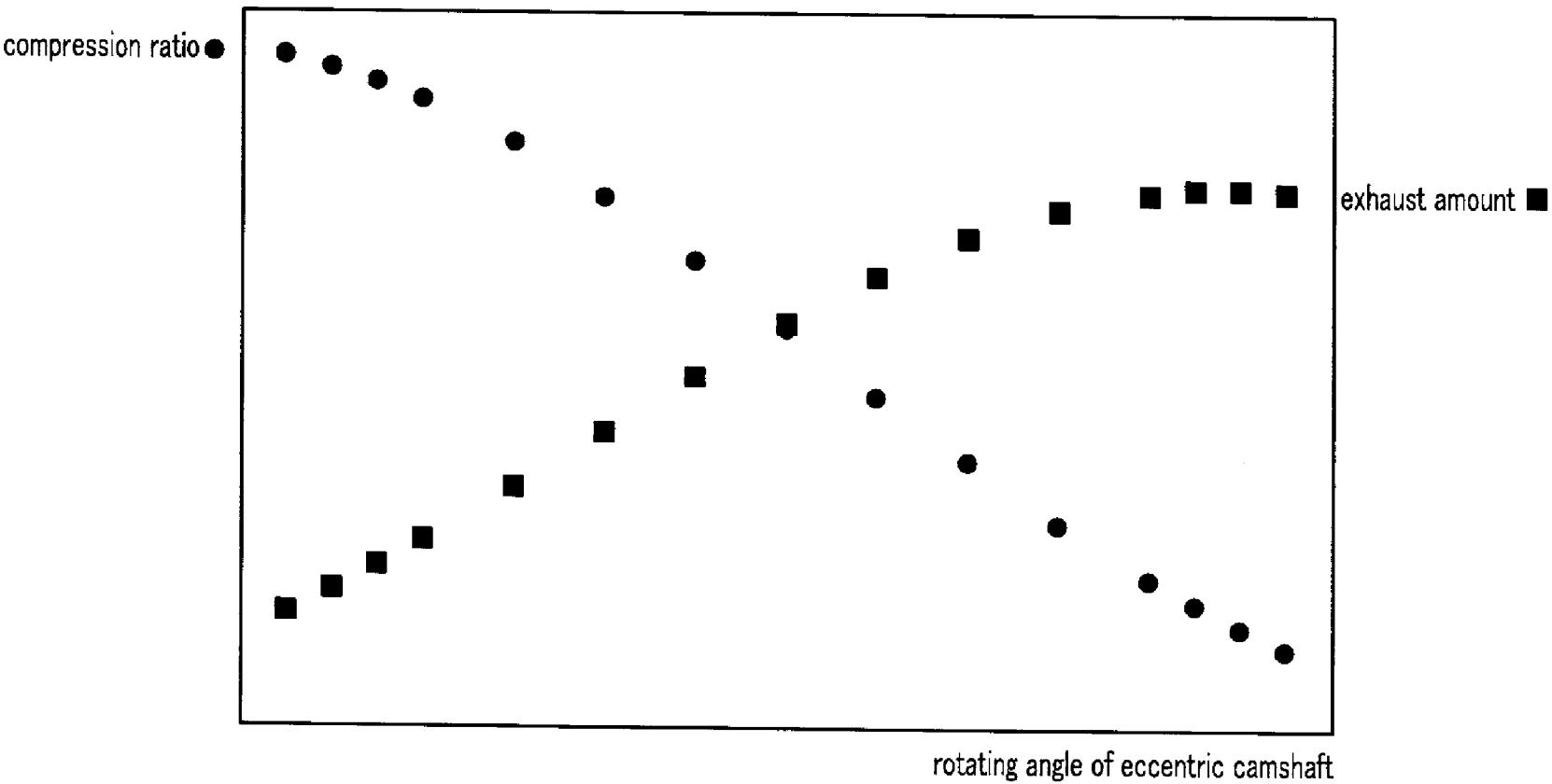
FIG. 7 is a graph showing a relationship between an exemplary exhaust amount and compression ratio in a variable compression ratio apparatus according to the present invention.

FIG. 7 is a graph showing a relationship between an exhaust amount and compression ratio in a variable compression ratio apparatus according to various embodiments of the present invention.

As shown in FIG. 7, according to various embodiments of the present invention, relation between the exhaust amount and the compression ratio can be described as an inverse function. Therefore, the exhaust amount and the compression ratio can be simultaneously controlled by rotating the eccentric camshaft 110 according to various embodiments of the present invention.

Since a connecting link, a sub control link, and a main control link are disposed substantially vertically next to a crankshaft, the volume of a crank case may not be increased.

In addition, since stroke and exhaust amount as well as compression ratio of an air-fuel mixture can be changed according to a driving condition of an engine, fuel mileage may be enhanced and exhaust may be reduced.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus that is mounted at an engine receiving a combustion force of an air-fuel mixture from a piston and rotating a crankshaft, and that changes compression ratio of the air-fuel mixture, comprising:

a connecting rod rotatably connected to the piston so as to receive the combustion force therefrom;

a pin link mounted to the crankshaft and rotatably connected to the connecting rod so as to receive the combustion force from the connecting rod and rotate the crankshaft;

a connecting link rotatably coupled to the pin link and changing a rotation trace of the pin link with respect to a rotation axis of the crankshaft;

an eccentric camshaft provided with first and second shaft portions eccentric from each other and configured to rotate by a predetermined angle according to a driving condition of the engine;

a sub control link rotatably connected to the eccentric camshaft about the first shaft portion and rotatably connected to the connecting link; and a main control link rotatably connected to the eccentric camshaft about the second shaft portion and rotatably connected to the connecting link.

2. The variable compression ratio apparatus of claim 1, wherein an angle between the sub control link and the main control link with respect to a rotation axis of the eccentric cam shaft is configured to change in a case that the eccentric camshaft rotates by the predetermined angle.

3. The variable compression ratio apparatus of claim 2, wherein the connecting link changes the rotation trace of the pin link around the rotation axis of the crankshaft in accordance with the change of the angle between the sub control link and the main control link with respect to the rotation axis of the eccentric cam shaft.

4. A variable compression ratio apparatus that is mounted at an engine receiving a combustion force of an air-fuel mixture from a piston and rotating a crankshaft, and that changes compression ratio of the air-fuel mixture, comprising:

a connecting rod having one end portion rotatably connected to the piston and the other end portion;

a pin link having a first connecting point rotatably connected to the other end portion of the connecting rod, a second connecting point rotatably connected to the crankshaft, and a third connecting point;

a connecting link having a fourth connecting point rotatably connected to the third connecting point of the pin link, and fifth and sixth connecting points;

a sub control link having one end portion rotatably connected to the sixth connecting point of the connecting link and the other end portion;

a main control link having one end portion rotatably connected to the fifth connecting point of the connecting link and the other end portion; and an eccentric camshaft rotatably connected respectively to the other end portions of the main control link and the sub control link, wherein rotation axes of the other end portions of the main control link and the sub control link are configured to be offset so as to change an angle between the main control link and the sub control link with respect to a rotation axis of the eccentric camshaft.

5. The variable compression ratio apparatus of claim 4, wherein the eccentric camshaft comprises:

a first shaft portion at which the other end portion of the sub control link is rotatably mounted; and a second shaft portion eccentrically disposed from the first shaft portion, the other end portion of the main control link being rotatably mounted at the second shaft portion.

6. The variable compression ratio apparatus of claim 5, wherein the eccentric camshaft is configured to rotate by a predetermined angle according to a driving condition of the engine so as to change the angle between the main control link and the sub control link with respect to the rotation axis of the eccentric camshaft.

7. The variable compression ratio apparatus of claim 6, wherein the connecting link is configured to change a rotation trace of the pin link around a rotation axis of the crankshaft in accordance with the change of the angle between the sub control link and the main control link with respect to the rotation axis of the eccentric camshaft.

8. The variable compression ratio apparatus of claim 4, wherein the first, second, and third connecting points form a first predetermined triangular shape.

9. The variable compression ratio apparatus of claim 4, wherein the fourth, fifth, and sixth connecting points form a second predetermined triangular shape.

* * * * *